US010247398B2

(12) United States Patent
Kerese et al.

(10) Patent No.: US 10,247,398 B2
(45) Date of Patent: Apr. 2, 2019

(54) LUMINAIRE ASSEMBLY AND TILTING MECHANISM FOR THE LUMINAIRE ASSEMBLY

(71) Applicant: GE Lighting Solutions, LLC, East Cleveland, OH (US)

(72) Inventors: Eszter Kerese, Budapest (HU); Gábor Ocskó, Budapest (HU); Tamás Vásárhelyi, Budapest (HU)

(73) Assignee: GE Lighting Solutions, LLC, East Cleveland, OH (US)

( * ) Notice: Subject to any disclaimer, the term of this patent is extended or adjusted under 35 U.S.C. 154(b) by 0 days.

(21) Appl. No.: 15/412,042

(22) Filed: Jan. 22, 2017

(65) Prior Publication Data

US 2018/0209622 A1 Jul. 26, 2018

(51) Int. Cl.
*F21V 21/30* (2006.01)
*F21S 8/04* (2006.01)
(Continued)

(52) U.S. Cl.
CPC ..... *F21V 21/30* (2013.01); *F21S 8/033* (2013.01); *F21S 8/04* (2013.01); *F21V 14/02* (2013.01); *F21V 19/02* (2013.01); *F21Y 2115/10* (2016.08)

(58) Field of Classification Search
CPC ..... F21V 21/30; F21V 21/28; F21V 21/26; F21V 21/095; F21V 21/08858; F21V 21/0965; F21L 4/027; F21Y 2115/10
See application file for complete search history.

(56) References Cited

U.S. PATENT DOCUMENTS 2,137,286 A 11/1938 Herbig
8,262,265 B2 * 9/2012 Hsieh ..... F21S 6/002 362/153
(Continued)

FOREIGN PATENT DOCUMENTS

CN 201448782 U 5/2010
CN 104566002 A 4/2015
(Continued)

OTHER PUBLICATIONS

"Commercial Portal: EXT4-0001 26W 3 Circuit Led Track Light," Da Voluce Lighting Studio, Copyright © 2016-2017 Da Voluce Lighting Studio, Retrieved from the Internet URL: http://www.davolucelighting.com.au/Gentech-Lighting-EXT4-0001-26W-3-Circuit-LED-Track-Lights.html, on Jun. 13, 2017, pp. 1-4.
(Continued)

*Primary Examiner* — Robert J May
(74) *Attorney, Agent, or Firm* — Peter T. DiMauro; GPO Global Patent Operation

(57) ABSTRACT

A tilting mechanism for a luminaire assembly is provided. The tilting mechanism includes a first rotating connection between a first housing of the luminaire assembly and an exterior surface. The first housing configured to pivot relative to the exterior surface around a first axis defined by the first rotating connection. The tilting mechanism also includes a second rotating connection between the first housing and a second housing of the luminaire assembly. The second housing is configured to pivot relative to the first housing around a second axis defined by the second rotation connection. The first axis defined by the first rotating connection between the first housing and the exterior surface and the second axis defined by the second rotating connection between the first and second housing are transversely oriented with each other.

17 Claims, 6 Drawing Sheets

(51) Int. Cl.

| | |
|---|---|
| ***F21V 14/02*** | (2006.01) |
| ***F21V 19/02*** | (2006.01) |
| ***F21S 8/00*** | (2006.01) |
| *F21Y 115/10* | (2016.01) |

(56) References Cited

U.S. PATENT DOCUMENTS

| | | | | |
|---|---|---|---|---|
| 2013/0128561 | A1* | 5/2013 | Thomas ..... | F21S 8/038<br>362/157 |
| 2015/0092417 | A1 | 4/2015 | Hoog | |
| 2015/0338073 | A1 | 11/2015 | Neuer et al. | |

FOREIGN PATENT DOCUMENTS

| | | | |
|---|---|---|---|
| DE | 10 2008 007647 | A1 | 8/2009 |
| WO | 2009/098028 | A1 | 8/2009 |
| WO | 2017/093988 | A1 | 6/2017 |

OTHER PUBLICATIONS

Extended European Search Report and Opinion issued in connection with corresponding EP Application No. 18152114.7 dated May 9, 2018.

* cited by examiner

LUMINAIRE ASSEMBLY AND TILTING MECHANISM FOR THE LUMINAIRE ASSEMBLY

BACKGROUND

Some luminaires are adjustable in that the luminaires can change orientations relative to a wall or surface to which the luminaires are attached. This can allow for a person to change where light generated by the luminaire is directed.

One known mechanism for changing the orientation of a luminaire is by pivoting the optic of the luminaire about a single pivot point or about two perpendicular axes. This type of mechanism, however, is limited in the various directions in which the light can be directed.

Another mechanism for changing the orientation of a luminaire is a stretchable or extendable portion of the luminaire, such as a corrugated pipe. This mechanism can increase the number of directions in which the light can be directed. But, this mechanism also is prone to wear down and fail before the useful life of the remaining components of the luminaire have been reached.

BRIEF DESCRIPTION

In one embodiment, a luminaire assembly includes a first housing configured to be coupled with an exterior surface with a first rotating connection. The first housing configured to pivot relative to the exterior surface around a first axis defined by the first rotating connection. The luminaire assembly also includes a second housing coupled with the first housing by a second rotating connection. The second housing is configured to pivot relative to the first housing around a second axis defined by the second rotation connection. One or more of the first housing or the second housing is configured to hold one or more light generating devices of the luminaire assembly.

In one embodiment, a tilting mechanism for a luminaire assembly is provided. The tilting mechanism includes a first rotating connection between a first housing of the luminaire assembly and an exterior surface. The first housing configured to pivot relative to the exterior surface around a first axis defined by the first rotating connection. The tilting mechanism also includes a second rotating connection between the first housing and a second housing of the luminaire assembly. The second housing is configured to pivot relative to the first housing around a second axis defined by the second rotation connection. The first axis defined by the first rotating connection between the first housing and the exterior surface and the second axis defined by the second rotating connection between the first and second housing are transversely oriented with each other.

In one embodiment, a luminaire assembly includes a first housing configured to be coupled with an exterior surface with a first fastener oriented along a first axis. The first housing is configured to rotate around the first axis relative to the exterior surface. The luminaire assembly also includes a second housing coupled with the first housing by a second fastener oriented along a second axis. The second housing is configured to rotate around a second axis relative to the first housing. Rotation of the first housing around the first axis also rotates the second housing around the first axis. The second housing is configured to hold one or more light generating devices.

BRIEF DESCRIPTION OF THE DRAWINGS

The present inventive subject matter will be better understood from reading the following description of non-limiting embodiments, with reference to the attached drawings, wherein below.

DETAILED DESCRIPTION

One or more embodiments of the inventive subject matter described herein provide tilting mechanisms for luminaire assemblies. The tilting mechanisms include a rotational point in an axis of symmetry of a lamp (or light generating device) of the luminaire. The entire luminaire assembly (e.g., the housing and light generating device or devices) can rotate around or about this axis, which can allow the luminaire assembly to rotate a complete 360 degrees around or about the axis of symmetry (or vertical axis where the luminaire assembly is connected with the ceiling in a room or building).

The tilting mechanism also includes a slanted surface at the interface between different portions of the housing of the luminaire assembly. An upper housing portion may be connected with a wall or ceiling by the rotational point, while a lower housing portion is connected with the upper housing portion by the slanted surface. The lower housing portion can rotate relative to the upper housing portion about or around an axis that is perpendicular to the slanted surface.

The combination of the rotation about the axis of symmetry or vertical axis and the rotation about the axis that is perpendicular to the slanted interface between the housing portions allows for the light emanating from the luminaire assembly to be directed in more different directions than known luminaire assemblies. Additionally, because no parts of the luminaire assembly rely on the flexing or stretching of any components of the luminaire assembly to change the direction of light, the tilting mechanisms described herein can have longer useful lives than the luminaire assemblies that rely on components that stretch or flex to change the direction in which light is directed.

Figure 1:
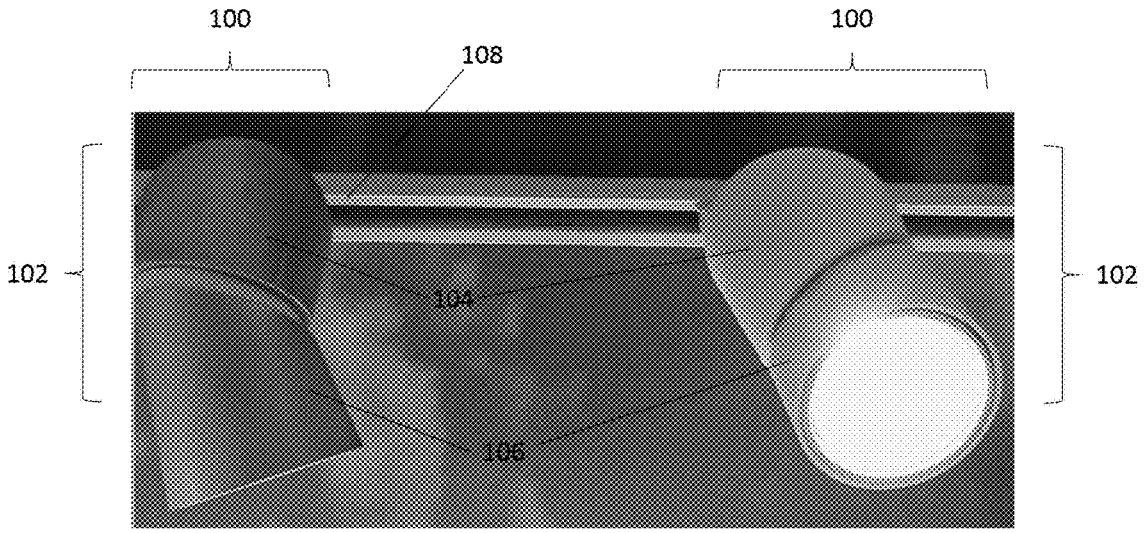
FIG. 1 illustrates two luminaire assemblies having one example of a tilting mechanism.
Figure 2:
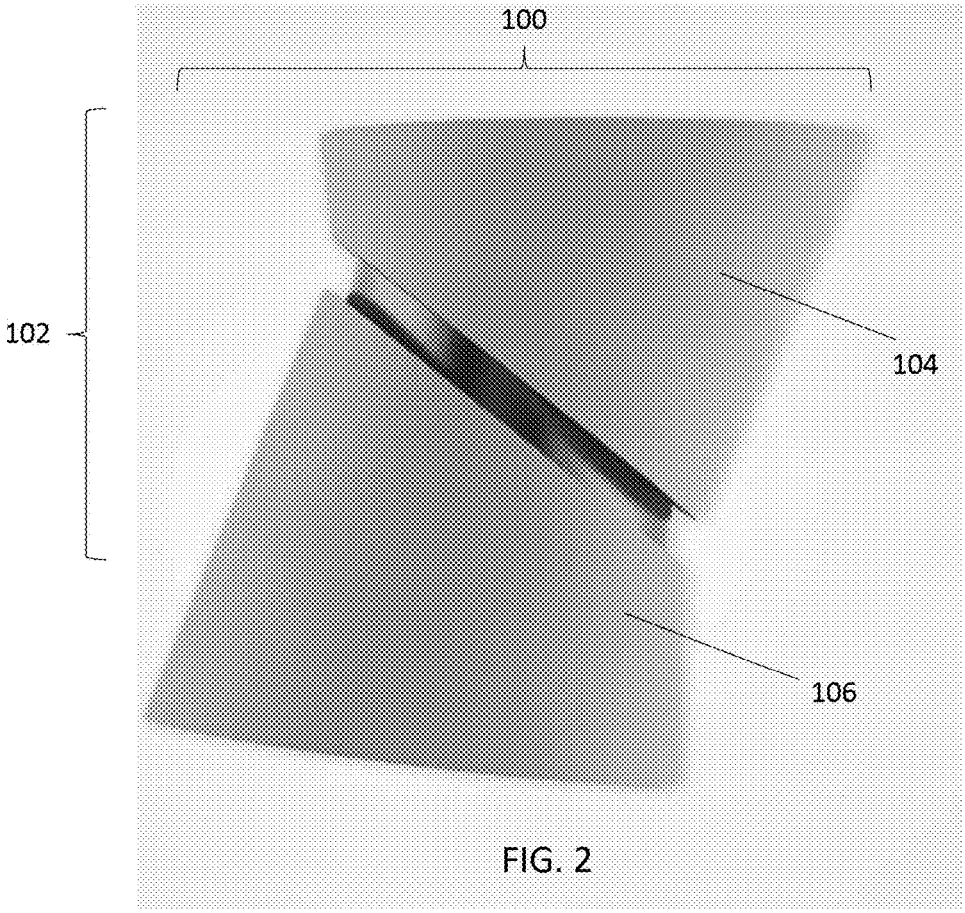
FIG. 2 illustrates a side view of one of the luminaire assemblies shown in FIG. 1.

FIG. 1 illustrates two luminaire assemblies 100 having one example of a tilting mechanism 102. FIG. 2 illustrates a side view of one of the luminaire assemblies 100 shown in FIG. 1. The tilting mechanism 102 includes or is formed from plural housings or housing portions 104, 106 of the luminaire assembly 100. The luminaire assemblies 100 each include the housings 104, 106, optic devices 108 (e.g., light generating devices, lenses, etc.), and the tilting mechanisms 102, with the tilting mechanisms 102 being formed from the housings 104, 106 and other components described herein.

The housing 104 can be referred to as an upper housing, and the upper housing 104 can be coupled with an exterior surface 108. The housing 104 may be referred to as the upper housing, even though one or more uses of the luminaire assembly 100 and the tilting mechanism 102 may result in the housing 104 being lower than or even with the housing 106 along a vertical direction or axis. The exterior surface 108 to which the upper housing 104 can be coupled may be a surface that is outside of the luminaire assembly 100, such as a rail connected with a ceiling or wall (or the ceiling or wall without the rail), even if the surface is an indoor surface or a surface that is outside of a building or structure. The housing 104 may be coupled with the exterior surface 108 by a first rotating connection, as described below.

The housing 106 can be referred to as a lower housing. The lower housing 106 is coupled with the upper housing 104 by a second rotating connection. This second rotating connection allows the housings 104, 106 to rotate relative to each other. The second rotating connection is provided by a slanted surface or interface between the housings 104, 106, as described below. The combination of the first and second rotating connections of the tilting mechanism 102 allow for the light generated by the optic devices 108 to be oriented in all or substantially all directions from the luminaire assembly 100.

Figure 3:
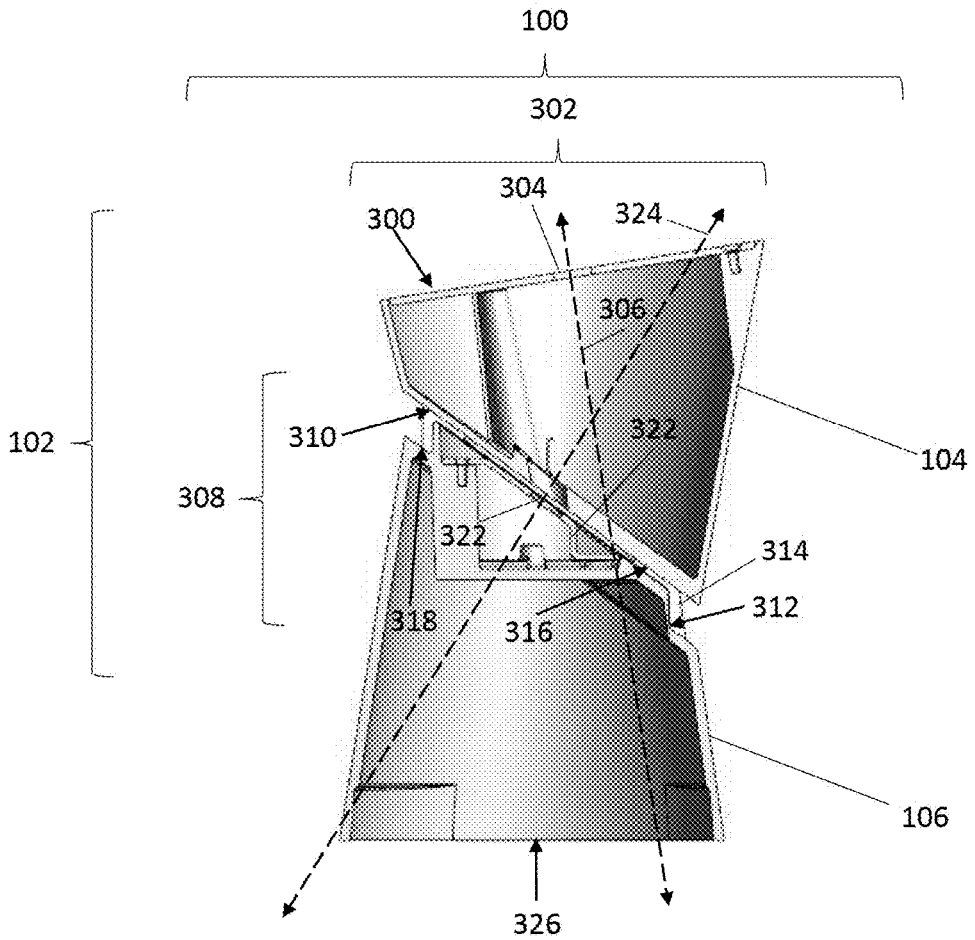
FIG. 3 illustrates a cross-sectional view of the luminaire assembly shown in FIG. 1 according to one example.
Figure 4:
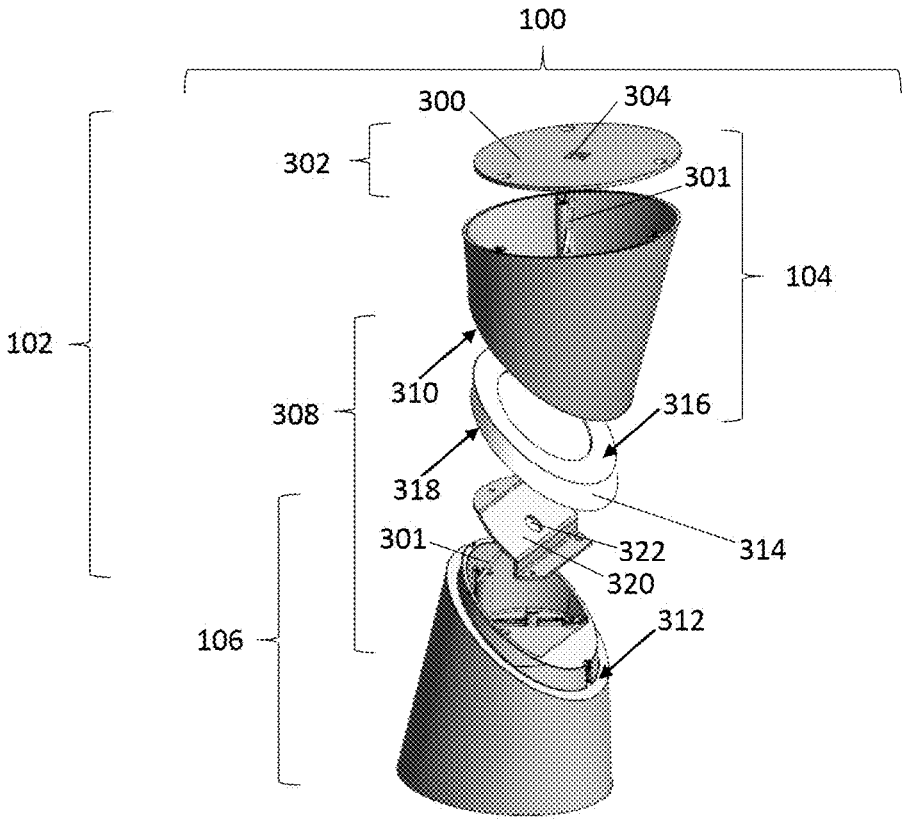
FIG. 4 illustrates an exploded view of the luminaire assembly shown in FIG. 1 according to one example.

FIG. 3 illustrates a cross-sectional view of the luminaire assembly 100 according to one example. FIG. 4 illustrates an exploded view of the luminaire assembly 100 according to one example. The upper housing 104 includes an upper surface 300 that at least partially engages (e.g., abuts) the exterior surface 108 shown in FIG. 1. A first rotating connection 302 of the tilting mechanism 102 described above can be provided by a fastener 301 (e.g., a screw) extending though an opening 304 in the surface 300 and being coupled with the exterior surface 108. This fastener may be oriented along a vertical axis 306 (shown in FIG. 3) of the luminaire assembly 100. The upper housing 104 and remainder of the luminaire assembly 100 can rotate about or around the fastener and the vertical axis 306 of the luminaire assembly 100 using the first rotating connection 302.

A second rotating connection 308 of the tilting mechanism 102 is provided by slanted surfaces 310, 312 of the housings 104, 106 and a slanted interface body 314 disposed between the housings 104, 106. As shown in FIGS. 3 and 4, the interface body 314 has opposite surfaces 316, 318 that separately engage (e.g., abut) different ones of the slanted surfaces 310, 312 of the housings 104, 106. Alternatively, the slanted interface body 314 may not be included in the tilting mechanism 102, and the surfaces 310, 312 of the housings 104, 106 may engage (e.g., abut) each other.

The surfaces 310, 312, 316, 318 are oriented at non-perpendicular angles with respect to the vertical axis 306. For example, the surfaces 316, 318 of the interface body 314 and the surfaces 310, 312 of the housings 104, 106 are slanted in that these surfaces 310, 312, 316, 318 are acutely or obliquely oriented with respect to the vertical axis 306. A coupling plate 320 is connected with the lower housing 106 by one or more fasteners 301, and includes another opening 322 through which an additional fastener can extend and be coupled with the upper housing 104. This additional fastener through the opening 322 lower housing 106 can serve as an additional axis of rotation 324 (shown in FIG. 3). The lower housing 106 (including the coupling plate 320) can rotate around or about the additional axis of rotation 324 to allow the lower housing 106 to rotate relative to the upper housing 104. A combination of the rotation about the vertical axis 306 and the rotation about the additional axis 324 allows for the light emanating from a lower surface 326 of the lower housing 106 to be directed in a wide variety of directions.

Figure 5:
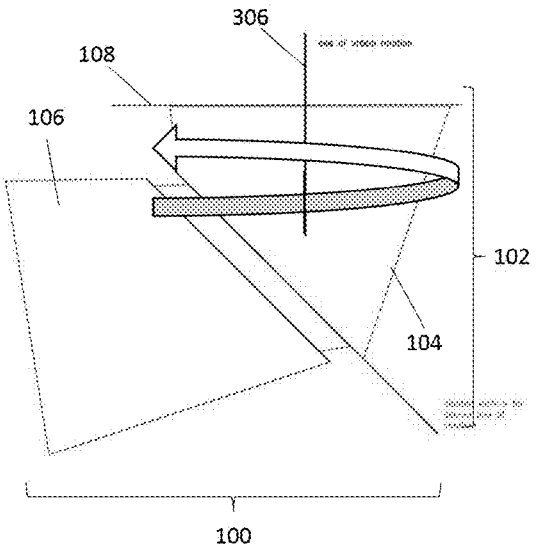
FIG. 5 illustrates rotation of upper and lower housings of the luminaire assembly shown in FIG. 1 about a vertical axis of the tilting mechanism shown in FIG. 1 according to one example.
Figure 6:
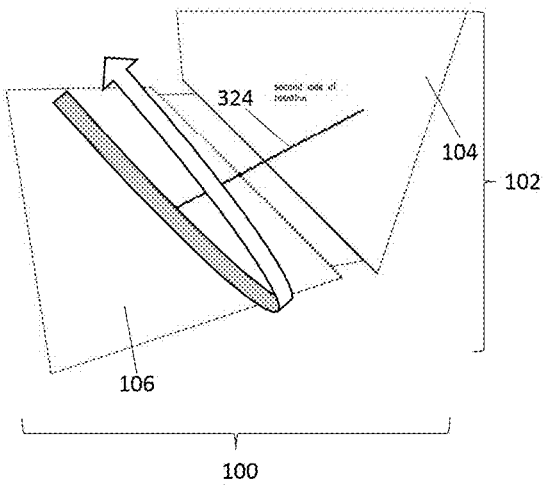
FIG. 6 illustrates rotation of the lower housing of the luminaire assembly about an additional axis relative to the upper housing of the luminaire assembly according to one example.

FIG. 5 illustrates rotation of the upper and lower housings 104, 106 of the luminaire assembly about the vertical axis 306 of the tilting mechanism 102 according to one example. Rotation about the vertical axis 306 results in both the upper and lower housings 104, 106 rotating or pivoting around the vertical axis 306 relative to the exterior surface 108, as shown in FIG. 5. FIG. 6 illustrates rotation of the lower housing 106 of the luminaire assembly about the additional axis 324 relative to the upper housing 104 according to one example. Rotation of the lower housing 106 about the additional axis 324 results in only the lower housing 106 rotating or pivoting around the additional axis 324 relative to the upper housing 104, as shown in FIG. 6.

Figure 7:
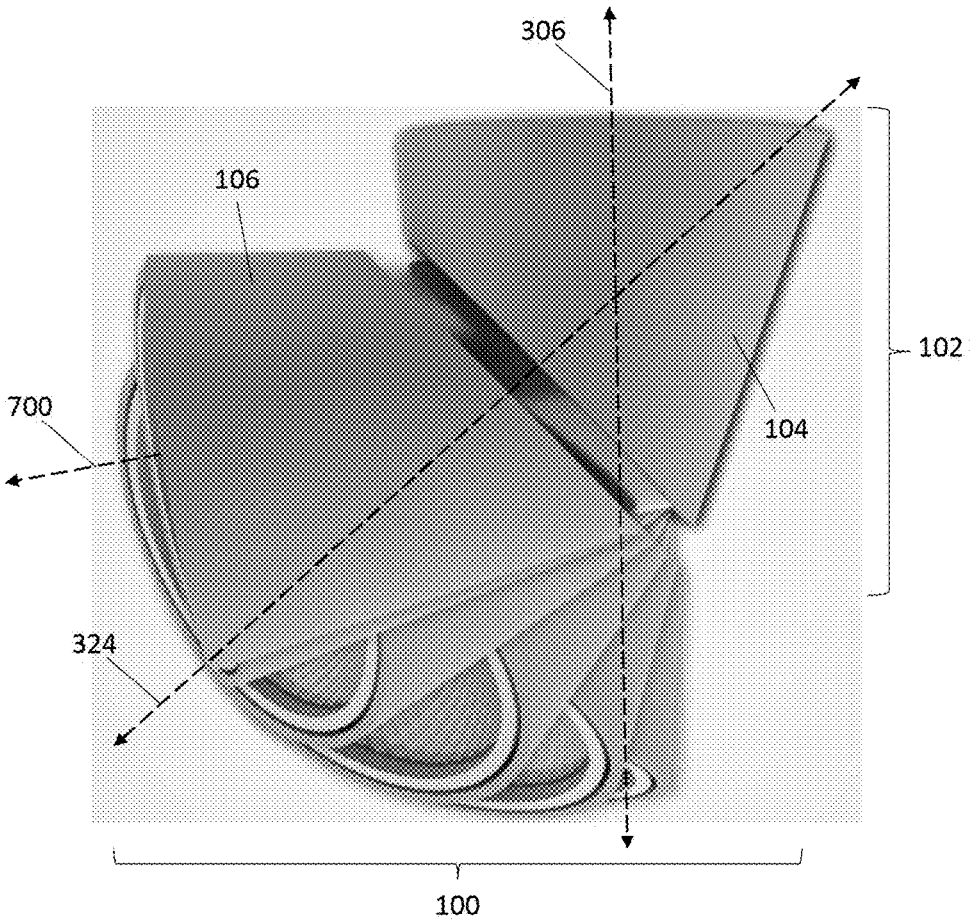
FIG. 7 illustrates movement of the tilting mechanism to adjust the direction in which light emanates from the luminaire assembly according to several examples.

FIG. 7 illustrates movement of the tilting mechanism 102 to adjust the direction in which light emanates from the luminaire assembly 100 according to several examples. Rotation about the vertical axis 306 and/or additional axis 324 allows for the direction in which light emanates from the lower housing 106 to be controlled from among a wide variety of different directions without stretching or flexing any part of the luminaire assembly 100. For example, the lower housing 106 can be rotated about or around the additional axis 324 to orient an optical axis 700 of the light emitted out from the lower housing 106 at a desired or selected angle relative to the vertical axis 306. The upper and lower housings 104, 106 may be concurrently, previously, and/or subsequently be rotated about the vertical axis 306 to move this optical axis to a desired or selected direction. The housings 104, 106 may be rigid, non-stretchable bodies such that rotation of the upper housing 104 about the vertical axis 306 also causes rotation of the lower housing 106 and the additional axis 324 about the vertical axis 306. The housings 104, 106 may be rigid, non-stretchable bodies such that rotation of the lower housing 106 about the additional axis 324 does not cause rotation of the upper housing 104 about the additional axis 324. This rotation may move the optical axis 700 about the vertical axis 306 along a shape of a cone, with the apex angle of the cone defined by (e.g., being the same as or one half of) the angle between the additional axis 324 and the vertical axis 306.

In one embodiment, a method for using the tilting mechanism to adjust the direction in which light is directed from the luminaire assembly includes rotating the upper housing and the lower housing about the vertical axis and/or rotating the lower housing about the additional axis. One or both of these rotations can result in the direction in which light emanates from the luminaire assembly being controlled among many different options.

As used herein, an element or step recited in the singular and proceeded with the word "a" or "an" should be understood as not excluding plural of said elements or steps, unless such exclusion is explicitly stated. Furthermore, references to "one embodiment" of the presently described subject matter are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

It is to be understood that the above description is intended to be illustrative, and not restrictive. For example, the above-described embodiments (and/or aspects thereof)

may be used in combination with each other. In addition, many modifications may be made to adapt a particular situation or material to the teachings of the subject matter set forth herein without departing from its scope. While the dimensions and types of materials described herein are intended to define the parameters of the disclosed subject matter, they are by no means limiting and are exemplary embodiments. Many other embodiments will be apparent to those of skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the subject matter set forth herein, including the best mode, and also to enable a person of ordinary skill in the art to practice the embodiments of disclosed subject matter, including making and using the devices or systems and performing the methods. The patentable scope of the subject matter described herein is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A luminaire assembly comprising:

a first housing configured to be coupled with an exterior surface with a first rotating connection, the first housing configured to pivot relative to the exterior surface around a first axis defined by the first rotating connection; and a second housing coupled with the first housing by a second rotating connection, the second housing configured to pivot relative to the first housing around a second axis defined by the second rotation connection, wherein one or more of the first housing or the second housing is configured to hold one or more light generating devices of the luminaire assembly;

wherein the second housing is configured to hold one or more light generating devices; and wherein a slanted interface body is disposed between the first housing and the second housing, said slanted interface body comprising opposite surfaces that separately engage slanted surfaces of the first housing and the second housing.

2. The luminaire assembly of claim 1, wherein the first axis defined by the first rotating connection between the first housing and the exterior surface and the second axis defined by the second rotating connection between the first and second housing are transversely oriented with each other.

3. The luminaire assembly of claim 1, wherein the second housing is configured to rotate around the first axis by rotation of the first housing around the first axis.

4. The luminaire assembly of claim 1, wherein the second housing is configured to rotate around the first axis such that the second axis defined by the second rotation connection also rotates around the first axis.

5. The luminaire assembly of claim 1, wherein the first housing and the second housing are configured to completely rotate around the first axis.

6. The luminaire assembly of claim 1, wherein the first housing and the second housing are formed from rigid, non-stretchable bodies or rigid, non-extendable bodies.

7. The luminaire assembly of claim 1, wherein the first housing is prevented from rotating around the second axis defined by the second rotating connection while the first housing is coupled with the exterior surface.

8. The luminaire assembly of claim 1, wherein the first rotating connection includes at least one fastener between the first housing and the first exterior surface.

9. The luminaire assembly of claim 1, wherein the first housing is configured to be coupled with a ceiling or wall as the exterior surface.

10. A tilting mechanism for a luminaire assembly, the tilting mechanism comprising:

a first rotating connection between a first housing of the luminaire assembly and an exterior surface, the first housing configured to pivot relative to the exterior surface around a first axis defined by the first rotating connection; and a second rotating connection between the first housing and a second housing of the luminaire assembly, the second housing configured to pivot relative to the first housing around a second axis defined by the second rotation connection, wherein the first axis defined by the first rotating connection between the first housing and the exterior surface and the second axis defined by the second rotating connection between the first and second housing are transversely oriented with each other;

wherein a slanted interface body is disposed between the first housing and the second housing, said slanted interface body comprising opposite surfaces that separately engage slanted surfaces of the first housing and the second housing.

11. The tilting mechanism of claim 10, wherein one or more of the first housing or the second housing is configured to hold one or more light generating devices of the luminaire assembly.

12. The tilting mechanism of claim 10, wherein the second housing is configured to rotate around the first axis by rotation of the first housing around the first axis.

13. The tilting mechanism of claim 10, wherein the second housing is configured to rotate around the first axis such that the second axis defined by the second rotation connection also rotates around the first axis.

14. The tilting mechanism of claim 10, wherein the first housing and the second housing are configured to completely rotate around the first axis.

15. The tilting mechanism of claim 10, wherein the first housing and the second housing are formed from rigid, non-stretchable bodies or rigid, non-extendable bodies.

16. The tilting mechanism of claim 10, wherein the first housing is prevented from rotating around the second axis defined by the second rotating connection while the first housing is coupled with the exterior surface.

17. The tilting mechanism of claim 10, wherein the first rotating connection includes at least one fastener between the first housing and the first exterior surface.

* * * * *